US009567697B2

(12) United States Patent
Fang et al.

(10) Patent No.: US 9,567,697 B2
(45) Date of Patent: Feb. 14, 2017

(54) PREPARATION METHOD OF JACQUARD SANDWICH MESH FABRIC WITH TWO-COLORED SURFACE

(71) Applicant: PUTIAN HUAFENG INDUSTRIAL & TRADE CO., LTD., Fujian (CN)

(72) Inventors: Huashan Fang, Fujian (CN); Huayu Fang, Fujian (CN); Tianyu Xu, Fujian (CN); Yinquan Yao, Fujian (CN); Liqiong Zhuo, Fujian (CN); Tianyuan Li, Fujian (CN); Jiantong Wu, Fujian (CN); Daneshvar Kamran, Fujian (CN)

(73) Assignee: PUTIAN HUAFENG INDUSTRIAL & TRADE CO., LTD., Fujian (CN)

( * ) Notice: Subject to any disclaimer, the term of this patent is extended or adjusted under 35 U.S.C. 154(b) by 0 days.

(21) Appl. No.: 14/770,456

(22) PCT Filed: Apr. 2, 2014

(86) PCT No.: PCT/CN2014/074640
§ 371 (c)(1),
(2) Date: Aug. 25, 2015

(87) PCT Pub. No.: WO2015/149304
PCT Pub. Date: Oct. 8, 2015

(65) Prior Publication Data

US 2016/0040333 A1 Feb. 11, 2016

(51) Int. Cl.

| | |
|---|---|
| ***D04B 37/04*** | (2006.01) |
| ***D04B 27/32*** | (2006.01) |
| ***D04B 21/08*** | (2006.01) |
| ***D04B 21/06*** | (2006.01) |
| ***D04B 27/14*** | (2006.01) |

(52) U.S. Cl.
CPC ..... *D04B 27/32* (2013.01); *D04B 21/06* (2013.01); *D04B 21/08* (2013.01); *D04B 27/14* (2013.01); *D04B 37/04* (2013.01)

(58) Field of Classification Search
CPC ..... D04B 21/08; D04B 21/06; D04B 21/20
See application file for complete search history.

(56) References Cited

U.S. PATENT DOCUMENTS

| | | | | |
|---|---|---|---|---|
| 3,646,779 A * | 3/1972 | Nuber | ..... | D04B 15/68 66/197 |
| 3,834,193 A * | 9/1974 | Wilkens | ..... | D04B 27/32 66/195 |
| 3,971,234 A * | 7/1976 | Taylor | ..... | D04B 1/18 66/172 E |

(Continued)

*Primary Examiner* — Danny Worrell
(74) *Attorney, Agent, or Firm* — Stein IP, LLC

(57) ABSTRACT

A preparation method of a jacquard sandwich fabric with a two-colored surface is disclosed, employing a jacquard warp knitting machine, comprising: 1) changing a guide bar configuration; 2) changing a jacquard control signal; 3) re-defining a basic stitch of a jacquard; 5) converting a designed pattern into a graphic diagram, and continuously modifying the pattern through the graphic diagram; 6) after finishing the pattern design, directly exporting a knitting document, importing the document into a machine file, and producing the jacquard sandwich mesh fabric with a two-colored surface. A weft laid-in stitch is added. The weft laid-in stitch can completely hide the yarns, so a two color effect can be obtained.

3 Claims, 1 Drawing Sheet

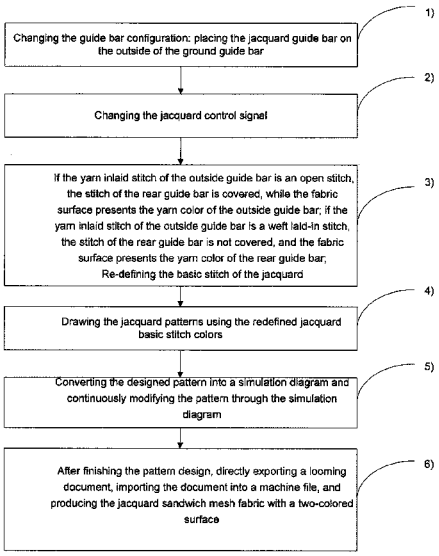

(56) References Cited

U.S. PATENT DOCUMENTS

| | | | | | |
|---|---|---|---|---|---|
| 3,999,407 | A | * | 12/1976 | Odham | D04B 21/18 66/193 |
| 4,233,824 | A | * | 11/1980 | Schneider | D04B 21/02 66/87 |
| 5,033,275 | A | * | 7/1991 | Fischer | D04B 21/02 66/84 R |
| 5,150,587 | A | * | 9/1992 | Bergmann | D04B 21/02 66/195 |
| 5,899,095 | A | * | 5/1999 | Spillane | D04B 21/06 66/195 |

* cited by examiner

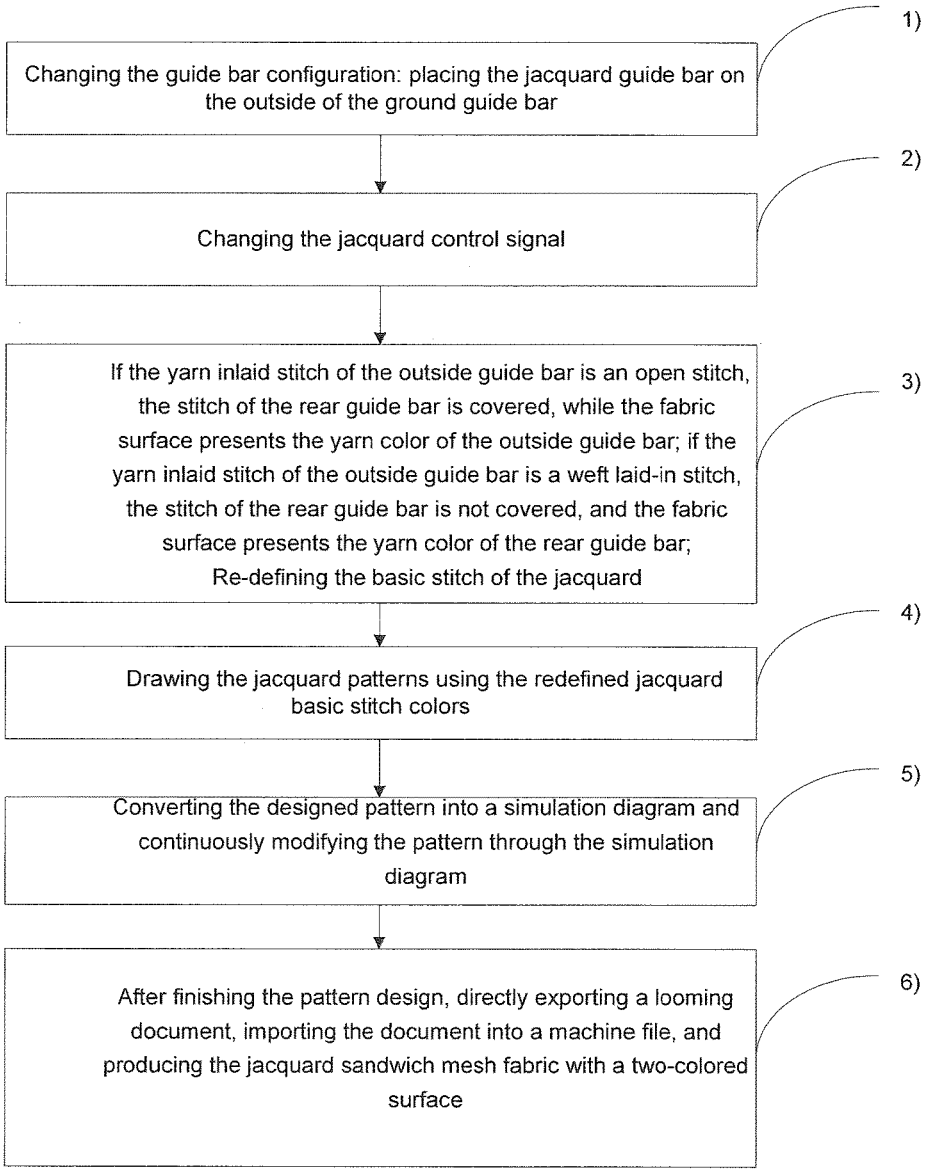
1)
Changing the guide bar configuration: placing the jacquard guide bar on the outside of the ground guide bar
2)
Changing the jacquard control signal
3)
If the yarn inlaid stitch of the outside guide bar is an open stitch, the stitch of the rear guide bar is covered, while the fabric surface presents the yarn color of the outside guide bar; if the yarn inlaid stitch of the outside guide bar is a weft laid-in stitch, the stitch of the rear guide bar is not covered, and the fabric surface presents the yarn color of the rear guide bar; Re-defining the basic stitch of the jacquard
4)
Drawing the jacquard patterns using the redefined jacquard basic stitch colors
5)
Converting the designed pattern into a simulation diagram and continuously modifying the pattern through the simulation diagram
6)
After finishing the pattern design, directly exporting a looming document, importing the document into a machine file, and producing the jacquard sandwich mesh fabric with a two-colored surface

PREPARATION METHOD OF JACQUARD SANDWICH MESH FABRIC WITH TWO-COLORED SURFACE

CROSS-REFERENCE TO RELATED APPLICATIONS

This application is a national stage of International Application No. PCT/CN2014/074640, filed Apr. 2, 2014, filed in the State Intellectual Property Office, the disclosure of which is incorporated herein by reference.

Technical Field

The present invention relates to a preparation process of a jacquard sandwich fabric, and in particular, to a preparation method of a jacquard sandwich mesh fabric with a two-colored surface.

Description of the Related Art

Current jacquard sandwich machines are equipped with a jacquard guide bar and a ground guide bar, forming different patterns through permutation and combination of different stitches; the fabric surface can only have a single color, and no other colors.

The traditional jacquard sandwich machines are equipped with a ground guide bar and a jacquard guide bar. Only one signal controls the jacquard action.

BRIEF SUMMARY OF THE INVENTION

The present invention solves the above technical problem and fulfills two inventive objectives: 1. Placing the jacquard guide bar on the outside of the ground guide bar to realize two-color treatment on the surface; 2: Adding a weft laid-in stitch which can completely hide the yarns and achieve the two-color effect.

To fulfill the above objective, the present invention employs the following technical solution:

A preparation method of a jacquard sandwich fabric with a two-colored surface, employing a jacquard warp knitting machine, comprising the following steps:

1) changing a guide bar configuration: placing a jacquard guide bar an the outside of a ground guide bar, which means that the first one is the jacquard guide bar, the second one is the ground guide bar; after the change, a yarn inlaid stitch of the jacquard guide bar is 0-1-1-1/2-1-1-K and a yarn inlaid stitch of the ground guide bar is 0-1-1-1/3-2-1-1/I;

2) changing a jacquard control signal: adding a new fluted disc controller and a control sensor to obtain two jacquard control signals, respectively at a position back to a needle and a position in front of a needle of the needle bed of the jacquard warp knitting machine;

3) when the yarn inlaid stitch of the outside guide bar is an open stitch, the stitch of the rear guide bar is covered, and a fabric surface presents a yarn color of the outside guide bar; when the yarn inlaid stitch of the outside guide bar is a weft laid-in stitch, the stitch of the rear guide bar is not covered, and the fabric surface presents the yarn color of the rear guide bar;

re-defining the basic stitch of the jacquard:

No. (1) color, namely defining a red color as a cord stitch, wherein the yarn inlaying code is 1-0/2-3//;

No. (4) color, namely defining a green color as a tricot stitch, wherein the yarn inlaying code is 1-0/1-2//;

No. (12) color, namely defining a white color as a mesh stitch, wherein the yarn inlaying code is 1-0/0-1//;

No. (2) color, namely defining a yellow color as a weft laid-in stitch, wherein the yarn inlaying code is 0-0/1-1//;

4) drawing jacquard patterns using the redefined jacquard basic stitch colors;

5) converting the designed pattern into a graphic diagram and continuously modifying the pattern through the graphic diagram; and 6) after finishing the pattern design, directly exporting a knitting document, importing the document into a machine file, and producing the jacquard sandwich mesh fabric with a two-colored surface.

The present invention has the beneficial effects that: the jacquard guide bar is placed on the outside of the ground guide bar, so the first one is the jacquard guide bar, and the second one is the ground guide bar. Previously, the yarn inlaid stitch of the ground guide bar was 1-0-1-1/0-1-1-1//, and that of the jacquard guide bar was 1-0-1-1/1-2-1-1//. After the change, the yarn inlaid stitch of the jacquard guide bar is 0-1-1-1/2-1-1-1//, and that of the ground guide bar is 0-1-1-1/3-2-1-1//. Based on the yarn coverage criteria, two colors are formed: when the yarn inlaid stitch of the outside guide bar is an open stitch, the stitch of the rear guide bar is covered, and the fabric surface presents the yarn color of the outside guide bar; when the yarn inlaid stitch of the outside guide bar is a weft laid-in stitch, the stitch of the rear guide bar is not covered, and the fabric surface presents the yarn color of the rear guide bar. In the present invention, the weft laid-in stitch is added. This stitch is not found in other patents. The weft laid-in stitch can completely hide the yarns, so the two color effect can be obtained.

BRIEF DESCRIPTION OF THE DRAWINGS

FIG. 1 illustrated a preparation method of a jacquard sandwich fabric with a two-colored surface; employing a jacquard warp knitting machine.

DETAILED DESCRIPTION OF THE PRESENT INVENTION

The technical contents, structure characteristics, fulfilled objective and effects of the present invention are described in detail with reference to the embodiments.

The present invention mainly uses improvement on equipment: change of the guide bar configuration, and improvement on the design steps, namely re-defining the basic stitch color of the jacquard, to realize the preparation of the jacquard sandwich mesh fabric with a two-color surface.

Jacquard guide bar: Guide bar equipped with a jacquard comb.

Ground guide bar: Guide bar equipped with common guide needles.

According to the present invention, as shown in FIG. 1, a preparation method of a jacquard sandwich fabric with a two-colored surface, employing a jacquard warp knitting machine, comprises the following steps:

1) Changing the guide bar configuration: placing the jacquard guide bar on the outside of the ground guide bar, which means that the first one is the jacquard guide bar, the second one is the ground guide bar; previously, the yarn inlaid stitch of the ground guide bar was 1-0-1-1/0-1-1-1//, and that of the jacquard guide bar was 1-0-1-1/1-2-1-1//; after the change, the yard inlaid stitch of the jacquard guide bar is 0-1-1/2-1-1-1//; and the yard inlaid stitch of the ground guide bar is 0-1-1-1/3-2-1-1//;

2) Changing the jacquard control signal: adding a new fluted disc controller and a control sensor to obtain two jacquard control signals, respectively at a position back to the needle and a position in front of the needle of the needle bed of the machine;

3) When the yarn inlaid stitch of the outside guide bar is an open stitch, the stitch of the rear guide bar is covered, and the fabric surface presents the yarn color of the outside guide bar; when the yarn inlaid stitch of the outside guide bar is a weft laid-in stitch, the stitch of the rear guide bar is not covered, and the fabric surface presents the yarn color of the rear guide bar;

Examples are as follows:

Yarn A is a 150 Dtex polyester filament yarn, light blue when dyed. Yarn A is threaded on the outside jacquard guide bar.

Yarn B is a 140 Dtex nylon filament yarn, yellow when dyed. Yarn B is threaded through the rear ground guide bar.

Case 1:

The yarn inlaid stitch of the jacquard guide bar is a looping stitch (0-1-1-1/2-1-1-1//), and that of the ground guide bar is 0-1-1-1/3-2-1-1//.

At this time, the stitch of yarn A covers that of yarn B, and the fabric surface represents the color of yarn A, namely light blue.

Case 2:

The yarn inlaid stitch of the jacquard guide bar is a weft laid-in stitch (0-0-1-1/1-1-1-1//), and that of the ground guide bar is 0-1-1-1/3-2-1-1//. (In the present invention, the weft laid-in stitch is added. This stitch is not found in other patents. The weft laid-in stitch can completely hide the yarns, so the two color effect can be obtained.)

In such circumstances, the weft laid-in stitch of yarn A is completely hidden in the looping stitch of yarn B, and the fabric surface presents the color of yarn B, namely yellow.

Re-defining the basic stitch of the jacquard:

No. (1) Color, namely defining the red color as the cord stitch, wherein the yarn inlaying code is 1-0/2-3//;

No. (4) Color, namely defining the green color as the tricot stitch, wherein the yarn inlaying code is 1-0/1-2//;

No. (12) Color, namely defining the white color as the mesh stitch, wherein the yarn inlaying code is 1-0/0-1//;

No. (2) Color, namely defining the yellow color as the weft laid-in stitch, wherein the yarn inlaying code is 0-0/1-1//;

4) Drawing the jacquard patterns using the redefined jacquard basic stitch colors;

When the jacquard draws No. (1) Color, No. (4) Color and No. (12) Color, the fabric surface presents the color of yarn A—light green.

When the jacquard draws No. (2) Color, the fabric surface presents the color of yarn B—yellow.

5) Converting the designed pattern into a graphic diagram and continuously modifying the pattern through the graphic diagram;

6) After finishing the pattern design, directly exporting a knitting document, importing the document into a machine file, and producing the jacquard sandwich mesh fabric with a two-colored surface. The number of the jacquard control signals is changed into two, so corresponding amendments shall be made in the exported machine document. For example, the pattern height in the pattern document of the jacquard is 180 (unit: row); before the change, there were 180 pieces of control information of jacquard in the exported machine document; after change, there are 360 pieces of control information of jacquard in the exported machine document. Finally, the machine document is copied into the machine through a U disk to implement weaving to produce the two-colored jacquard sandwich mesh fabric.

In the present invention, the jacquard guide bar is placed on the outside of the ground guide bar, so the first one is the jacquard guide bar, and the second one is the ground guide bar. Previously, the yarn inlaid stitch of the ground guide bar was 1-0-1-1/0-1-1-1//, and that of the jacquard guide bar was 1-0-1-1/1-2-1-1//. After the change, the yarn inlaid stitch of the jacquard guide bar is 0-1-1-1/2-1-1-1//, and that of the ground guide bar is 0-1-1-1/3-2-1-1//. Based on the yarn coverage criteria, two colors are formed: when the yarn inlaid stitch of the outside guide bar is an open stitch, the stitch of the rear guide bar is covered, and the fabric surface presents the yarn color of the outside guide bar; when the yarn inlaid stitch of the outside guide bar is a weft laid-in stitch, the stitch of the rear guide bar is not covered, and the fabric surface presents the yarn color of the rear guide bar. In the present invention, the weft laid-in stitch is added. This stitch is not found in other patents. The weft laid-in stitch can completely hide the yarns, so the two color effect can be obtained.

The above are only some embodiments of the present invention and shall not be regarded as limit to the present invention. Any equivalent structure or equivalent flow modifications made on the basis of the description of the present invention, or director or indirect application to other related fields, shall fall within the protective scope of the present invention.

What is claimed is:

1. A preparation method of a jacquard sandwich fabric with a two-colored surface, employing a jacquard warp knitting machine, comprising:

1) changing a guide bar configuration: placing a jacquard guide bar on an outside of a ground guide bar, which means that the first one is the jacquard guide bar, the second one is the ground guide bar; after the change, a yarn inlaid stitch of the jacquard guide bar is 0-1-1-1/2-1-1-1//; and a yarn inlaid stitch of the ground guide bar is 0-1-1-1/3-2-1-1//;

2) changing a jacquard control signal: adding a new fluted disc controller and a control sensor to obtain two jacquard control signals, respectively at a position back to a needle and a position in front of the needle of a needle bed of the jacquard warp knitting machine;

3) if the yarn inlaid stitch of the outside guide bar is an open stitch, the stitch of the rear guide bar is covered, while a fabric surface presents a yarn color of the outside guide bar; if the yarn inlaid stitch of the outside guide bar is a weft laid-in stitch, the stitch of the rear guide bar is not covered, and the fabric surface presents a yarn color of the rear guide bar;

re-defining a basic stitch of the jacquard:

No. (1) color, namely defining a red color as a cord stitch, wherein a yarn inlaying code is 1-0/2-3//;

No. (4) color, namely defining a green color as a tricot stitch, wherein the yarn inlaying code is 1-0/1-2//;

No. (12) color, namely defining a white color as a mesh stitch, wherein the yarn inlaying code is 1-0/0-1//;

No. (2) color, namely defining a yellow color as the weft laid-in stitch, wherein the yarn inlaying code is 0-0/1-1//;

4) drawing jacquard patterns using the redefined jacquard basic stitch colors;

5) converting the designed pattern into a graphic diagram and continuously modifying the pattern through the graphic diagram; and 6) after finishing the pattern design, directly exporting a knitting document, importing the document into a machine file, and producing the jacquard sandwich mesh fabric with a two-colored surface.

2. The preparation method of a jacquard sandwich fabric with a two-colored surface according to claim 1, wherein in step 3) the yarn inlaid stitch of the jacquard guide bar is a looping stitch (0-1-1-1/2-1-1-1//), and that of the ground guide bar is 0-1-1-1/3-2-1-1//.

3. The preparation method of a jacquard sandwich fabric with a two-colored surface according to claim 1, wherein in step 3) the yarn inlaid stitch of the jacquard guide bar is a weft laid-in stitch (0-0-1-1/1-1-1-1//), and that of the ground guide bar is 0-1-1-1/3-2-1-1//.

* * * * *